US005199121A

United States Patent [19]

Payne

[11] Patent Number: 5,199,121

[45] Date of Patent: Apr. 6, 1993

[54] ADJUSTABLE FILL COMFORTER

[75] Inventor: Andrew H. Payne, Cincinnati, Ohio

[73] Assignee: Down Lite Products, Inc., Loveland, Ohio

[21] Appl. No.: 958,932

[22] Filed: Oct. 9, 1992

[51] Int. Cl.[5] ..... A47G 9/04; A47G 9/02; A47G 9/08

[52] U.S. Cl. ..... 5/502; 5/486; 5/413

[58] Field of Search ..... 5/502, 500, 486, 482, 5/413

[56] References Cited

U.S. PATENT DOCUMENTS

| | | | |
|---|---|---|---|
| 1,583,334 | 5/1926 | Bloom | 5/502 |
| 2,711,546 | 6/1955 | Light | 5/502 |
| 3,800,368 | 4/1974 | Simon | 24/216 |

FOREIGN PATENT DOCUMENTS

| | | | |
|---|---|---|---|
| 8906508 | 7/1989 | PCT Int'l Appl. | 5/502 |

OTHER PUBLICATIONS

92/93 Catalog, Down Lite International, Selected Pages.

*Primary Examiner*—Alexander Grosz
*Attorney, Agent, or Firm*—Frost & Jacobs

[57] ABSTRACT

A comforter comprising an outer fabric shell containing a fill of down or down-like material. The shell comprises a top panel and a bottom panel sewn together about their peripheral edges with the fill contained therebetween. The top and bottom shell panels are additionally joined together along at least one seam dividing the comforter into at least two areas. Along a portion at least of the at least one seam, the joinder of the top and bottom shell panels is releaable and restorable, forming a closable gap or passage in the seam through which the fill material can be shifted from one areas to the other to adjust the amount of fill in each area of the comforter.

21 Claims, 4 Drawing Sheets

ADJUSTABLE FILL COMFORTER

TECHNICAL FIELD

The invention relates to a comforter filled with down or down-like material, and more particularly to such a comforter wherein the weight of fill in the sleeping area of the comforter can be increased or decreased by shifting large portions of the fill between the sleeping area and perimeter areas of the comforter.

BACKGROUND ART

Comforters stuffed with down or down-like fill material are very popular for a number of reasons. They are warm and comfortable. Furthermore, they are characterized by bulk and softness. Finally, despite their bulk, they are extremely light in weight.

In general, the construction of the comforter, the type of fill material used, and the amount of fill material used, will determine the warmth characteristics of the structure. To this end, it is not unusual for manufacturers to offer various types and styles of comforters, differing in the fill material used and the amount of fill material used, so as to have different warmth characteristics.

The present invention is based upon the discovery that a given comforter can be provided with a range of warmth characteristics. This is accomplished by the user varying (increasing or decreasing) the weight of fill in the sleeping area of the comforter. For example, as the weather becomes warmer, a large portion of the fill can be moved to the perimeter of the comforter and maintained there, out of the sleeping area. When the weather turns cooler, a large portion of the fill is moved by the user from the perimeter of the comforter to the sleeping area and maintained there. In accordance with the teachings of the present invention, this change of weight of fill in the sleeping area of the comforter can be accomplished by the user without adding to or subtracting from the overall amount of fill within the comforter, and without opening the comforter shell.

DISCLOSURE OF THE INVENTION

According to the invention, there is provided a comforter comprising an outer fabric shell containing a fill of down or down-like material. The shell comprises a top panel and a bottom panel. The top and bottom shell panels are sewn together about their peripheral edges. The fill material is captively located and contained between the top and bottom shell panels The top and bottom shell panels are additionally joined together along at least one seam dividing the comforter into at least two areas. Along a portion at least of the last mentioned seam, the joinder of the top and bottom shell panels is releasable and restorable, forming a closable gap or passage in the seam between the at least two comforter areas. The fill material can be shifted from one area to the other through the closable gap so as to adjust the weight of fill in each area of the comforter without having to open the shell or add or subtract fill material.

In an exemplary embodiment of the present invention, a filled comforter is provided wherein the top and bottom shell panels are sewn together about their peripheries. The top and bottom shell panels are additionally sewn together to form channel frame areas along the sides and ends of the comforter. The central portion of the comforter may be of a traditional baffle karo-step design, a traditional sewn-through karo-step design, a traditional ring stitch design, or any other appropriate random flow construction as will be described hereinafter. Each of those seams, along which the top and bottom shell panels are sewn together to form the side channel areas, have a central interrupted portion where the top and bottom shell panels are not sewn together, but are releasably held together by appropriate fastening means such as snap-tape, or the like. As a consequence, these closable gaps in the seams forming the side channel frame areas constitute passages enabling the fill material from the central area to be shifted into the side channel frame, or vice-versa. In a second embodiment, the comforter is identical to that just described, with the exception that the seams forming the end channel frame areas of the comforter are also provided with reclosable gaps or passages for the same purpose. In a third embodiment, the comforter is identical to the first embodiment described above, with the exception that it is provided with an intermediate seam extending from end channel frame area to end channel frame area, dividing the comforter in half. The comforter, intended for use by two, has a reclosable gap in its center seam as well, so that the fill material may be shifted between the halves of the central sleeping area of the comforter as well as between each half and its respective adjacent side channel frame area.

The same general principle of the present invention can be applied to a sleeping bag structure, as will be described hereinafter with respect to FIG. 8.

DETAILED DESCRIPTION OF THE INVENTION

Figure 1:
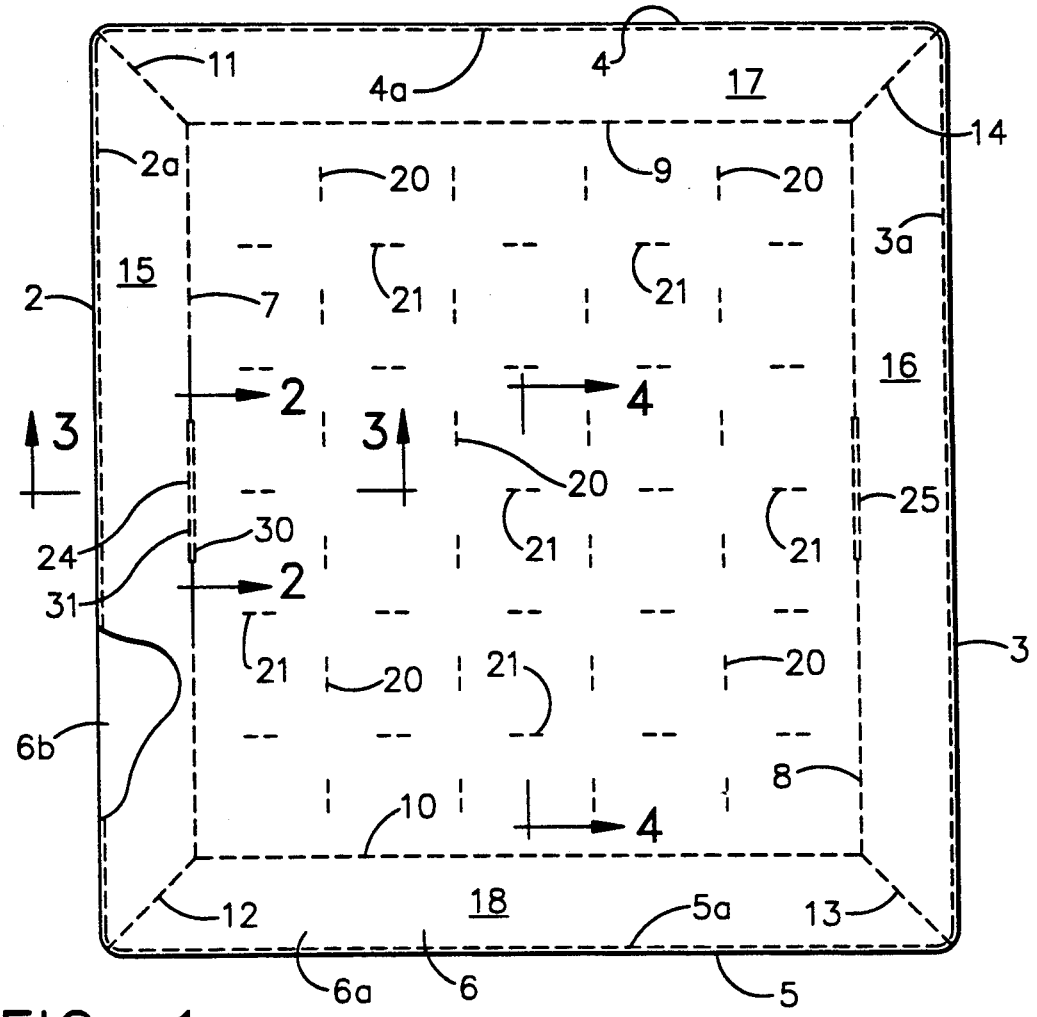
FIG. 1 is a fragmentary plan view of a comforter containing a down or down-like fill material and made in accordance with the teachings of the present invention.

In all of the Figures, like parts have been given like index numerals. Reference is first made to FIG. 1 wherein a comforter, made in accordance with the teachings of the present invention, is generally indicated at 1. The comforter has side edges 2 and 3 and end edges 4 and 5. End edges 4 and 5 are generally interchangeable, but for purposes of this description, end edges 4 can be considered as the head end of the comforter and end edge 5 can be considered the foot end of the comforter. The comforter comprises a fabric shell 6. The fabric shell 6 comprises two co-extensive fabric panels, a top panel 6a and a bottom panel 6b. The shell panels 6a and 6b are sewn together along their peripheral edges, as is diagrammatically indicated by broken lines at 2a, 3a, 4a, and 5a.

In a similar fashion, the top and bottom shell panels 6a and 6b are additionally sewn along rectilinear seams inset from the comforter edges 2, 3, 4 and 5 and indicated at 7, 8, 9 and 10. The top and bottom shell panels 6a and 6b are further sewn together along diagonal corner seams indicated at 11, 12, 13 and 14. The stitching between the shell top and bottom panels 6a and 6b, thus far described, creates channel frame pockets or areas about the edges of the comforter. The side channel frame areas are indicated at 15 and 16, while the head and foot end channel frame areas are indicated at 17 and 18 respectively. The channel frame areas 15 through 18 surround and define the central, rectangular sleeping area of the comforter indicated at 19.

Figure 4:
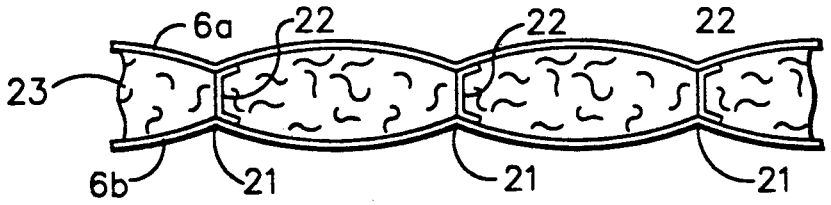
FIG. 4 is a fragmentary cross-sectional view taken along section line 4—4 of FIG. 1 and illustrates a baffle karo-step design.

In the exemplary embodiment illustrated, the top and bottom shell panels 6a and 6b, in the central sleeping area 19, are additionally joined together in a karo-step design. The lines of juncture are indicated by broken lines 20 and 21. In one embodiment, as is well known in the art, the top and bottom shell panels 6a and 6b are joined together at 20 and 21 by baffles 22. The baffles 22 are made of any appropriate material (such as nylon netting or the like), and are sewn along their edges to the upper shell panel 6a and the lower shell panel 6b as shown in FIG. 4. This construction, known in the art, is generally referred to as a baffle karo-step design.

Figure 5:
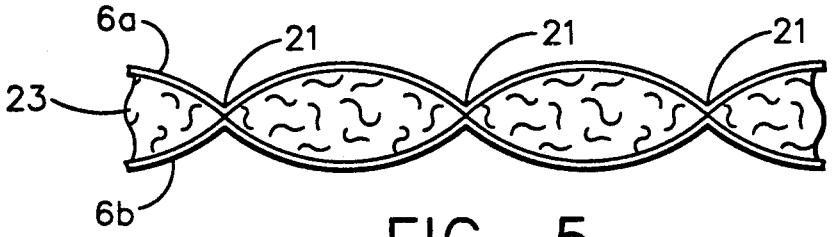
FIG. 5 is a fragmentary cross-sectional view, similar to FIG. 4, and illustrates a sewn-through karo-step design.

Alternatively, the upper and lower shell panels 6a and 6b may be directly sewn together along the lines 20 and 21 of FIG. 1. This is illustrated in FIG. 5, wherein the top and bottom shell panels 6a and 6b are shown sewn directly together at 21. Such a construction is well known in the art and is generally referred to as a sewn-through karo-step design. FIGS. 4 and 5 illustrate alternate ways in which the top and bottom shell panels 6a and 6b can be joined together along the lines 21. It will be understood that joinder of the top and bottom shell panels 6a and 6b along lines 20 can also be accomplished either as shown in FIG. 4 or as shown in FIG. 5. Regardless of whether the baffle karo-step design or the sewn-through karo-step design is used, the length of the lines 20 and 21 may be varied, so long as they do not intersect and there is therefore passages between them through and along which the fill material 23 may be shifted.

The present invention is not intended to be limited to the use of a karo-step design. There are other well known random flor designs. A ring stitch design, for example, could be used.

The top and bottom panels 6a and 6b of the shell 6 may be made of any appropriate material. While not intended to be so limited, 100% cotton fabric is often a preferred material for this purpose.

The fill material 23 may be any appropriate material having the flow characteristics required by the present invention (i.e., such that it may be easily shifted from one area of the comforter to another). Appropriate fill materials include down, feathers, a combination of down and feathers, blown polyester, cotton balls and the like. Down, for example, has superior flow characteristics and is readily shiftable from one area of the comforter to another.

Referring again to FIG. 1, it will be noted that the longitudinal seams 7 and 8 which separate the central sleeping area 19 from the side channel frame areas 15 and 16, are interrupted intermediate their lengths, as at 24 and 25. At 24 and 25, the top and bottom panels 6a and 6b of the comforter shell 6 are not sewn directly together, but rather are joined together by releasable means, forming in the seams 7 and 8 openable and reclosable gaps or passages at 24 and 25.

Any appropriate means can be used to join the upper and lower shell panels 6a and 6b together at the passages 24 and 25 along seams 7 and 8, respectively, so long as the means can be easily manipulated through the fabric of the top and bottom panels 6a and 6b. Such means include the well-known pressure actuated hook and loop tapes, tapes bearing equally spaced hook and eye elements, zipper means or the like. Preferably the means used is non-metallic so as to be free of rust or corrosion.

Figure 2:
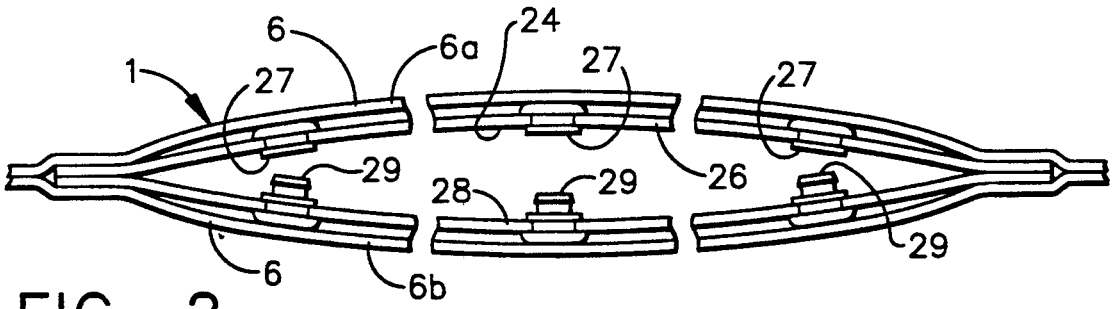
FIG. 2 is a fragmentary cross-sectional view taken along section line 2—2 of FIG. 1.
Figure 3:
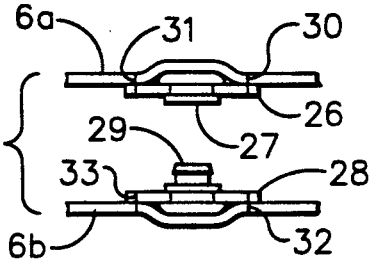
FIG. 3 is a fragmentary cross-sectional view taken along section line 3—3 of FIG. 1.

Excellent results have been achieved with the use of a conventional, readily available snap tape assembly. Such a snap tape assembly is shown in FIGS. 2 and 3, which constitute cross-sectional views taken along section lines 2—2 and 3—3 of FIG. 1, illustrating the gap 24. The snap tape assembly comprises a first fabric tape 26 having a plurality of plastic female snap fastener elements affixed thereto and evenly spaced therealong. The snap tape assembly also comprises a second fabric tape 28, having affixed thereto a plurality of plastic male snap elements 29, evenly spaced therealong and positioned to cooperate with the female snap elements 27. As is most clearly shown in FIG. 3, the first tape 26 is sewn directly to the top shell panel 6a by two rows of stitches 30 and 31. Similarly, the second tape 28 of the snap tape assembly is sewn directly to the bottom shell panel 6b by parallel rows of stitches 32 and 33. An exemplary snap tape assembly, suitable for use in the present invention, is illustrated and described in U.S. Pat. No. 3,800,368.

From the above description, it will be apparent that the gap or passage 24 can be readily located and identified by the user, by simply locating the double row of stitches 30 and 31 along the seam 7. By gently pulling the top shell panel 6a away from the bottom shell panel 6b, the snap elements 27 and 29 of the snap tape assembly will disengage from each other, opening the passage 24. The snap elements 27 and 29 of the snap tape assembly can readily be reengaged simply by "feel" through the fabric of the top and bottom shell panels 6a and 6b.

The length of the passage or gap 24 does not constitute a limitation of the present invention. The passage 24, for example, could constitute the majority of the length of seam 7. It has been found, however, that a gap of from about 10 inches to about 15 inches is adequate for the purposes of the present invention and is easier to manipulate.

It will understood that the gap 25 is identical to the gap 24, and FIGS. 2 and 3 could be considered illustrations of gap 25, as well.

The embodiment of FIGS. 1–4 having been described in detail, the manner of its use may now be set forth. Assuming that the down or down-like fill 23 is relatively evenly dispersed within the channel frame areas 15–18 and the sleeping area 19, should the weather become colder, the passages 24 and 25 may be opened, and a large portion of the fill material 23 from the channel frame areas 15 and 16 may be shifted through the passages 24 and 25 to the sleeping area 19. This shifting may be easily accomplished by the user, simply by rubbing his hand over the channel frame areas 15 and 16 toward the passage 24 and 25, respectively. Any flat, panel-like element, preferably with a rounded edge, may also be used for this purpose. Once the fill material has been shifted into the sleeping area 19, the passage 24 and 25 are closed as described above.

As the weather becomes warmer, the user may desire to reduce the weight of fill in the sleeping area 19. This is accomplished by opening the passages 24 and 25 and directing a large portion of the fill material to either side and into the side channel frame areas 15 and 16. Once this is accomplished, the passages 24 and 25 may again be closed. In this way, the fill material may be shifted between side channel frame areas 15 and 16 and the sleeping area 19 of the comforter, enabling the comforter to have a range of warmth characteristics and to be used throughout various seasons of the year.

Figure 6:
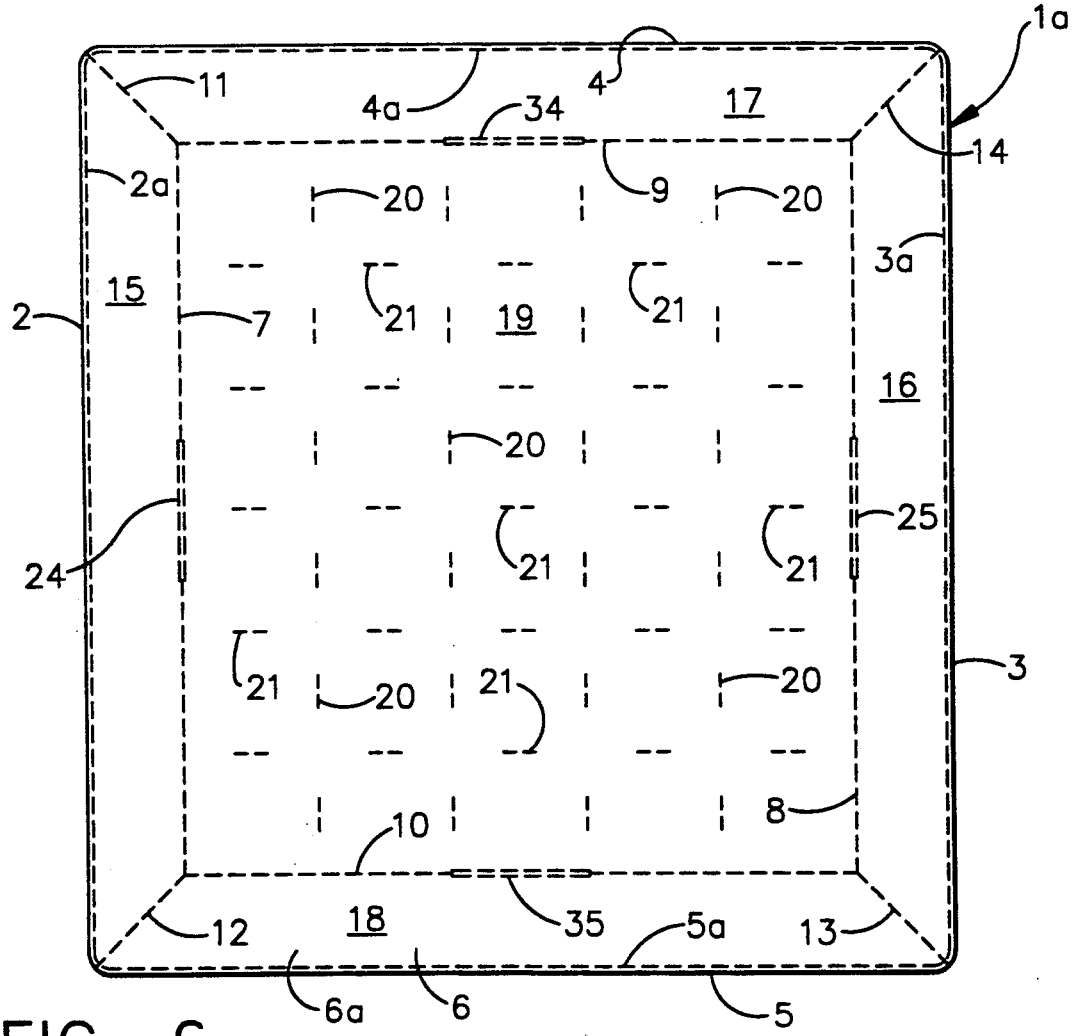
FIG. 6 is a plan view of a second embodiment of comforter according to the present invention.

FIG. 6 illustrates a second embodiment of the present invention, generally indicated at la. The second embodiment is similar to the embodiment illustrated in FIGS. 1–4 and like parts have been given like index numerals. The second embodiment differs from the first only in that additional reclosable gaps or passages 34 and 35 are provided in seams 9 and 10, respectively, enabling a shifting of the fill material between the sleeping area 19 of the comforter and all four of the side and end channel frame areas 15, 16, 17 and 18. The operation and manner of use of the passages 34 and 35 are identical to those described with respect to passages 24 and 25.

Figure 7:
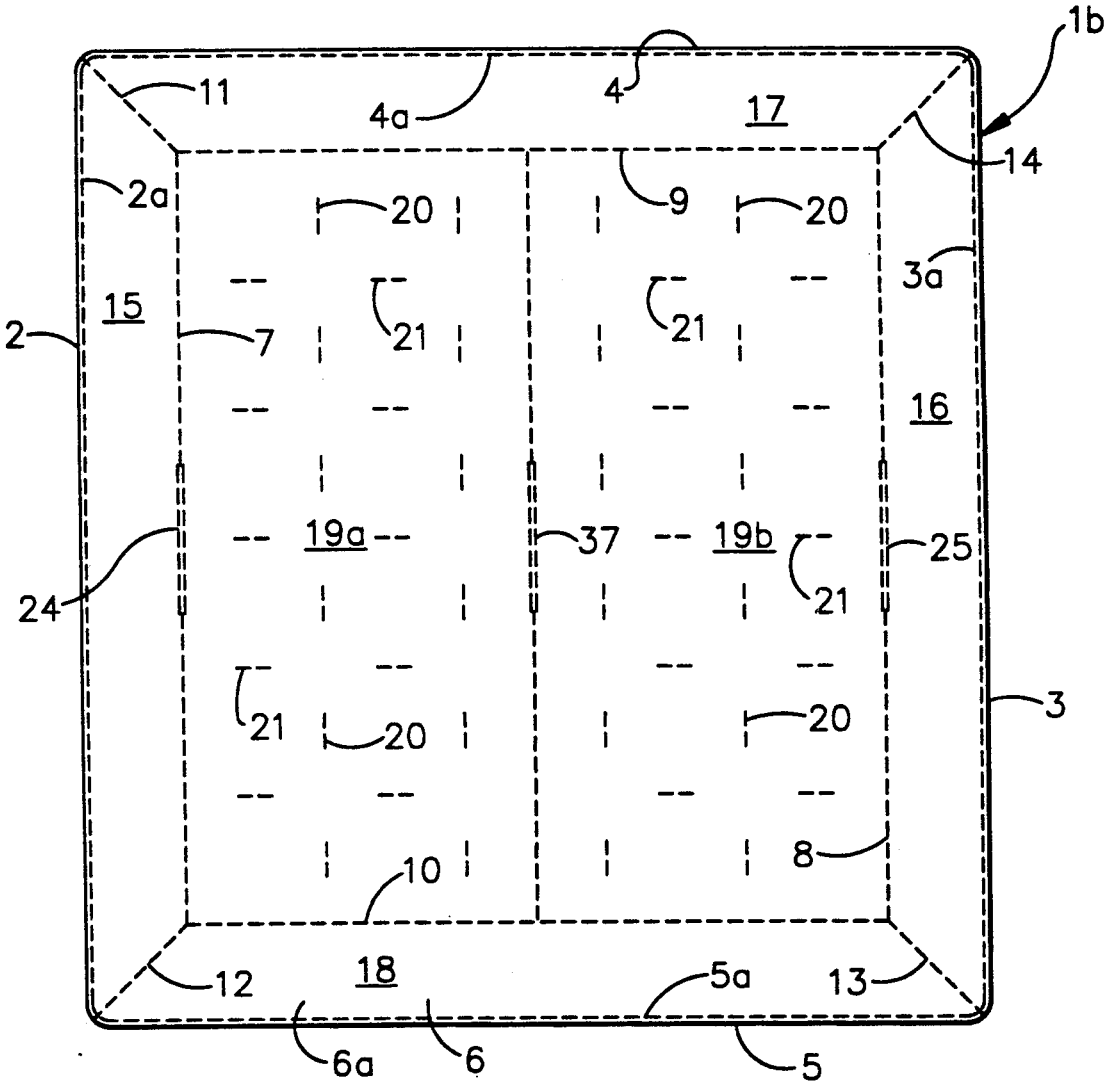
FIG. 7 is a plan view of a third embodiment of comforter according to the teachings of the present invention.

A third embodiment of the comforter of the present invention is illustrated in FIG. 7 and is generally indicated at lb. In most respects, the comforter **1*b* is identical to the comforter of FIG. 1. The only difference lies in the fact that the comforter 1*b* is provided with an additional, centrally located, rectilinear seam, extending between seams 9 and 10. The seam contains a passage 37 identical to passages 24 and 25. The seam and passage 37 divide the sleeping area of the mattress into two parts 19*a* and 19*b***.

The embodiment of FIG. 7 is intended for use by two people and the comforter areas **19*a* and 19*b* constitute sleeping areas for each of the two bed occupants. The passages 24 and 25, identical to passages 24 and 25 of the embodiment of FIG. 1, enable shifting of the fill material 23 between sleeping area 19*a* and the adjacent side channel frame area 15, and between sleeping area 19*b* and the adjacent side channel area 16. In addition, if one of the occupants requires more warmth than the other, fill material can be shifted between the sleeping areas 19*a* and 19*b*, through Passage 37**.

Figure 8:
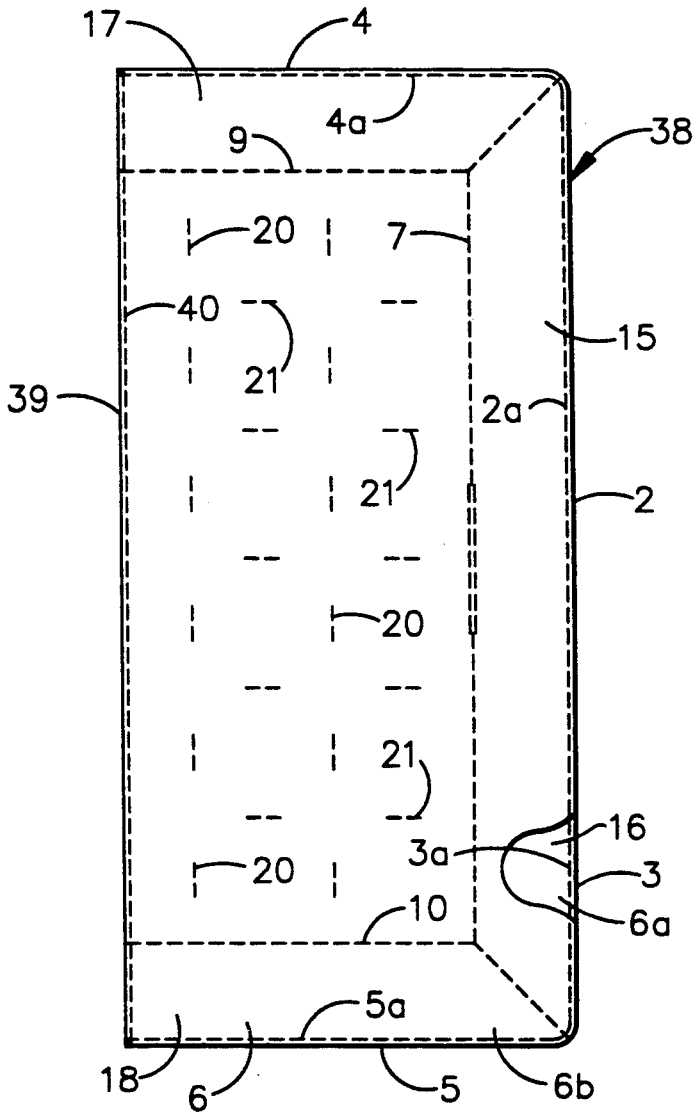
FIG. 8 is a fragmentary plan view of a sleeping bag embodying the teachings of the present invention.

The principle of the present invention may also be applied to sleeping bag structures. This is illustrated in FIG. 8. In FIG. 8, the sleeping bag is generally indicated at 38. In its simplest form, and for purposes of explanation, the sleeping bag 38 may be considered to be substantially identical to the comforter 1 of FIG. 1 folded upon itself along its long center. To this end, the head end edge is indicated at 4, the foot end edge is indicated and the side edges are shown at 2 and 3. It will be noted that the comforter side edge 2 is broken away to expose the side edge 3 therebeneath. Along the central fold line 39 of the sleeping bag 38, the shell panels **6*a* and 6*b* of shell 6 are sewn together from head end edge 4 to foot end edge 5, as is diagrammatically indicated by broken line 40. The two halves of the structure may be permanently sewn or otherwise joined together along the foot and edge 5 and along the side edges 2 and 3 in any appropriate manner (not shown). Alternatively, the halves of the sleeping bag 38 may be releasably joined together along the foot end edge 5 and the side edges 2 and 3** by appropriate and well-known means (not shown) including zipper means, snap means, hook and loop tape means, and the like. Again, if desired, the central sleeping area may be of a baffle karo-step design, a sewn-through karo-step design, or any other appropriate random flow design.

It will be noted that the seam 7 is provided with a passage, as described with respect to FIG. 1. As a consequence, fill material may be shifted between the side channel area 15 and the sleeping area defined by seams 40, 7, 9 and 10. Similar fill shifting may be accomplished on the lower sleeping bag half, through a passage (not shown) equivalent to passage 25 of FIG. 1. In this way, a sleeping bag is provided having adjustable warmth characteristics and suitable for use during a number of seasons.

Modifications may be made in the invention without departing from the spirit of it. For example, seams may be provided in the shell which divide the comforter into areas varying in both size, shape and number. Selected one or ones of the seams may be provided with closable passages, enabling shifting of the fill material, as desired.

I claim:

1. A comforter adapted to cover a substantial body portion of a human user, comprising an outer fabric shell containing a fill material, said shell comprising a top fabric panel and a bottom fabric panel joined together about their peripheral edges, said fill material being captively located between said top and bottom shell panels, said top and bottom shell panels being additionally joined together along at least one seam dividing said comforter into at least two areas, along a portion at least of said at least one seam said joinder of said top and bottom shell panels being releasable and restorable comprising an openable and closable passage in said seam through which said fill material can be shifted between said at least two areas of said comforter to adjust the amount of said fill in said areas.

2. The comforter claimed in claim 1 wherein said fill material is down.

3. The comforter claimed in claim 1 wherein said fill material is chosen from the class consisting of down, a mixture of down and feathers, feathers, blown polyester, and cotton balls.

4. The comforter claimed in claim 1 wherein said fabric of said top and bottom shell panels is 100% cotton.

5. The comforter claimed in claim 1 including a snap tape assembly sewn to said top and bottom shell panels at the position of said portion of said at least one seam to render said passage openable and closable.

6. The comforter claimed in claim 1 wherein said comforter is rectangular having side and end edges, said top and bottom shell panels being joined together by rectilinear seams inset from, equal in number to, and parallel to said side and end edges, and defining a central rectangular sleeping area of said comforter, said comforter and said rectangular sleeping area having corresponding corners joined together by rectilinear seams therebetween also joining said top and bottom shell panels together, said seams thus far described further defining a channel frame area between said central rectangular area and each of said side and end edges of said comforter, said rectilinear seam forming the side of said central rectangular area adjacent one of said side edges of said comforter comprising said seam having said openable and closable passage therein between said central rectangular area and the adjacent one of said channel frame areas, and said rectilinear seam forming that side of said central rectangular area adjacent the other side edge of said comforter also having an openable and closable passage therein between said central rectangular area and the adjacent one said channel frame areas.

7. The comforter claimed in claim 6 including a snap tape assembly sewn to said top and bottom shell panels at the position of each of said passages to render said passages openable and closable.

8. The comforter claimed in claim 6 wherein said rectilinear seams forming those sides of said central rectangular area adjacent said ends of said comforter each have an openable and closable passage therein between said central rectangular area and the adjacent one of said channel frame areas.

9. The comforter claimed in claim 6 wherein said central rectangular area has a random flow design therein.

10. The comforter claimed in claim 6 wherein said central rectangular area has a sewn-through karo-step design therein.

11. The comforter claimed in claim 6 wherein said central rectangular area has a baffle karo-step design therein.

12. The comforter claimed in claim 8 including a snap tape assembly sewn to said top and bottom shell panels at the position of all of said passages to render said passages openable and closable.

13. The comforter claimed in claim 8 wherein said central rectangular area has a random flow design therein.

14. The comforter claimed in claim 8 wherein said central rectangular area has a sewn-through karo-step design therein.

15. The comforter claimed in claim 8 wherein said central rectangular area has a baffle karo-step design therein.

16. The comforter claimed in claim 6 including a central longitudinal seam extending between said rectilinear seams parallel to said ends of said comforter, said central seam joining said top and bottom shell panels together and dividing said central rectangular portion of said comforter into two halves, said central seam having an openable and closable passage therein between said two halves.

17. The comforter claimed in claim 16 including a snap tape assembly sewn to said top and bottom shell panels at the position of all of said passages to render said passages openable and closable.

18. The comforter claimed in claim 16 wherein said halves of said central rectangular area have a random flow design therein.

19. The comforter claimed in claim 16 wherein said halves of said central rectangular area have a sewn-through karo-step design therein.

20. The comforter claimed in claim 16 wherein said halves of said central rectangular area have a sewn-through karo-step design therein.

21. The comforter claimed in claim 6 including a central longitudinal seam joining said top and bottom shell panels and extending between said end edges of said comforter, said comforter being folded upon itself along said central longitudinal seam to form upper and lower halves, and means to join said upper and lower halves along said comforter side edges and one of said comforter end edges to form a sleeping bag.

* * * * *